US006948643B1

(12) United States Patent
Lohrman

(10) Patent No.: US 6,948,643 B1
(45) Date of Patent: Sep. 27, 2005

(54) FILL-THROUGH CONTAINER AND CLOSURE PACKAGE

(75) Inventor: Richard D. Lohrman, N. Aurora, IL (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 10/763,636

(22) Filed: Jan. 22, 2004

(51) Int. Cl.[7] ..... B65D 47/00

(52) U.S. Cl. ..... 222/556; 222/212; 222/490; 220/254.7

(58) Field of Search ..... 222/546, 547, 222/556, 562, 490, 482, 212, 541.9, 541, 222/563, 545; 220/254.3, 254.7, 256.1, 259.1

(56) References Cited

U.S. PATENT DOCUMENTS

| | | | | |
|---|---|---|---|---|
| 3,318,496 A | | 5/1967 | Ayotte et al. | |
| 4,335,560 A | | 6/1982 | Robinson | |
| 4,586,622 A | | 5/1986 | Walldorf | |
| 4,717,050 A | * | 1/1988 | Wright | 222/482 |
| 5,207,657 A | * | 5/1993 | Gibilisco | 604/295 |
| 5,556,008 A | * | 9/1996 | Silver et al. | 222/192 |
| 5,685,444 A | | 11/1997 | Valley | |
| 6,269,986 B1 | * | 8/2001 | Gross | 222/541.5 |
| 6,279,789 B1 | | 8/2001 | Krall | |
| 6,382,476 B1 | * | 5/2002 | Randall et al. | 222/545 |
| 6,484,909 B1 | * | 11/2002 | Valpuesta Landa | 222/541.5 |
| 6,575,330 B2 | * | 6/2003 | Rousselet | 222/1 |

* cited by examiner

*Primary Examiner*—Michael Mar
*Assistant Examiner*—M A Cartagena

(57) ABSTRACT

A closure and container package includes a container having a finish with a mouth opening through which product is both filled into and dispensed from the container. A closure includes a base mounted on the finish and having an opening aligned with the mouth opening of the container finish. A lid is connected to the closure base by an integrally molded hinge to pivot between an open position in which the lid is spaced from the opening in the base and a closed position in which the lid is adjacent to the base. The lid includes facility for engaging either the mouth opening of the container or the opening in the closure base to close such openings in the closed position of the lid. In particularly preferred embodiments of the invention, a fitment is removably carried by the lid. The fitment has a dispensing opening and a peripheral snap bead for engagement with either the container finish or the closure base to secure the fitment in position, such that the fitment thereafter provides the dispensing opening through which product can be dispensed from the container, and the lid cooperates with the fitment to open and close the dispensing opening.

27 Claims, 4 Drawing Sheets

FILL-THROUGH CONTAINER AND CLOSURE PACKAGE

The present invention is directed to product containment and dispensing packages, particularly fluid product containment and dispensing packages, and to a method of filling the package with the closure mounted on the container.

BACKGROUND AND SUMMARY OF THE INVENTION

In the manufacture and filling of closure and container packages, the containers and closures typically are shipped separately to a product packager, perhaps by different suppliers. The containers are filled with product by the packager in an automated or manual filling operation, and the closures are then applied to the containers, again either automatically or manually, to complete the package. The closures alternatively may be applied to the containers when the containers and closures are supplied to the packager. This alternative reduces inventory at the packager, but requires the extra step of removing the closure prior to filling the container, followed by re-application of the closure after filling. It is a general object of the present invention to provide a closure and container package in which the closure and container are provided as an assembly to the product packager, the package is filled with product through aligned fill openings in the closure and container—i.e., without removing the closure from the container—and a lid on the closure is then closed over the fill opening on the closure to complete the filled package. Another object of the present invention is to provide a closure and container package that may be prepackaged in shipping cases, and filled and closed while not removed from the shipping cases. This in-case filling feature greatly reduces handling costs at the packager.

A closure and container package in accordance with presently preferred but exemplary disclosed embodiments of the invention includes a container having a finish with a mouth opening through which product is both filled into and dispensed from the container. A closure includes a base mounted on the finish and having an opening aligned with the mouth opening of the container finish. A lid is connected to the closure base by an integrally molded hinge to pivot between an open position in which the lid is spaced from the opening in the base and a closed position in which the lid is adjacent to the base. The lid includes facility for engaging either the mouth opening of the container or the opening in the closure base to close such openings in the closed position of the lid. In particularly preferred embodiments of the invention, a fitment is removably carried by the lid. The fitment has a dispensing opening and a peripheral snap bead for engagement with either the container finish or the closure base to secure the fitment in position, such that the fitment thereafter provides the dispensing opening through which product can be dispensed from the container, and the lid cooperates with the fitment to open and close the dispensing opening.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
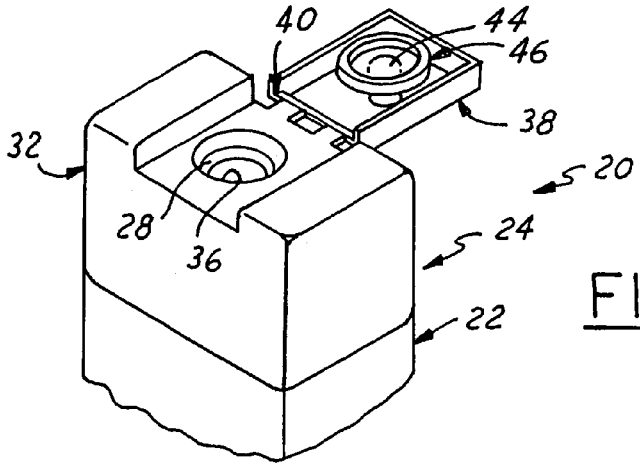
FIG. 1 is a fragmentary perspective view of a closure and container package in accordance with one presently preferred embodiment of the invention.
Figure 2:
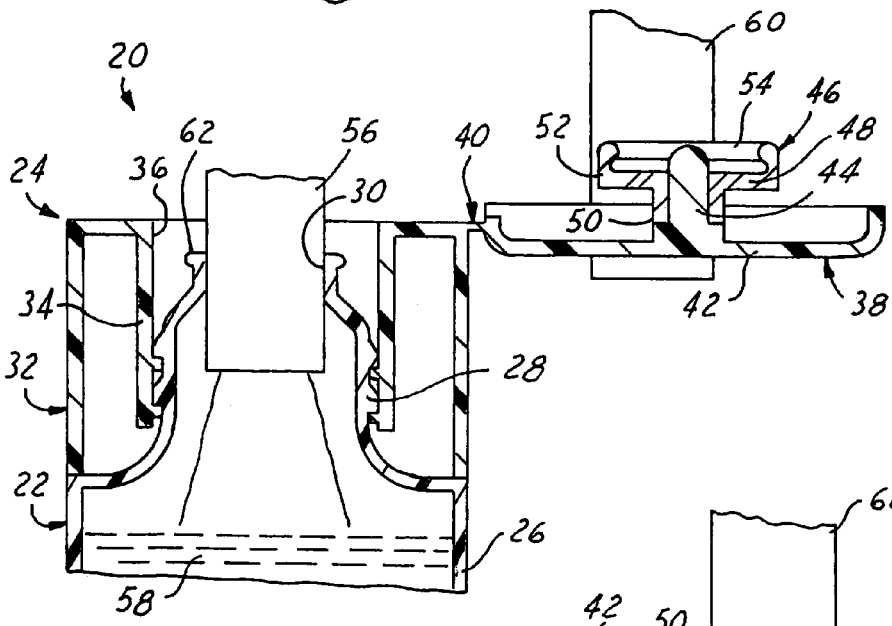
FIG. 2 is a fragmentary sectional view that illustrates filling of the package in FIG. 1.
Figure 3:
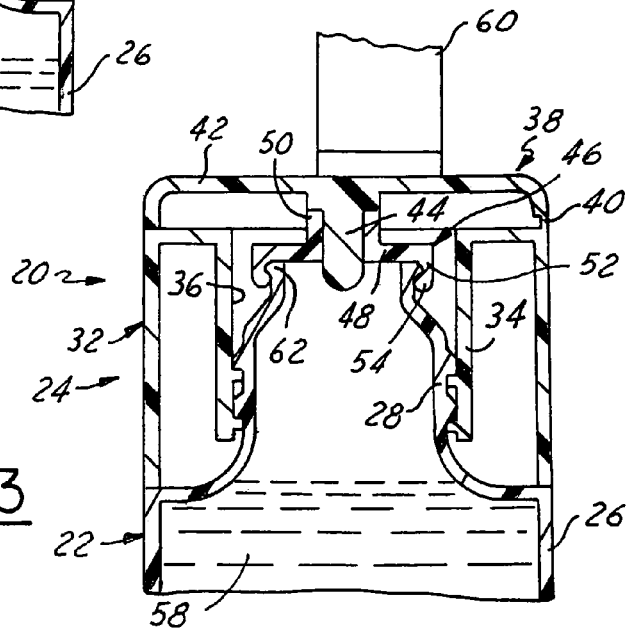
FIG. 3 is a fragmentary sectional view that illustrates closing of the package in FIGS. 1 and 2 after filling.

FIGS. 1–3 illustrate a closure and container package 20 in accordance with a first exemplary embodiment of the invention as comprising a container 22 and a dispensing closure 24. Container 22 has a body 26 and a cylindrical finish 28 that terminates in a mouth opening 30. Closure 24 includes a base 32 having a skirt 34 secured to container finish 28, such as by means of external threads or beads on finish 28 being engaged with internal threads or beads on skirt 34. Skirt 34 surrounds an opening 36 that is aligned in assembly with mouth opening 30 of container finish 28. A lid 38 is coupled to base 32 by means of an integrally molded hinge 40. Hinge 40 may be of any suitable single-element or multiple-element type, with a dual-element hinge of the type disclosed in U.S. Pat. No. 6,041,477 being currently preferred. Lid 38 includes a base wall 42 from which a spud 44 integrally extends. A fitment 46 is removably received over spud 44 on lid 38, and is suitably retained thereon such as by friction or small snap beads (not shown). Fitment 46 includes a flat annular base wall 48, a first annular wall 50 extending from the inner periphery of base wall 48 around spud 44, and a second annular wall 52 extending from the outer periphery of spud base wall 48. A circumferential bead 54 extends radially inwardly from wall 52 at a position spaced from base wall 48. Bead 54 may be circumferentially continuous or segmented.

Closure 24 is initially assembled to container 22 with lid 38 open, as illustrated in FIGS. 1 and 2. The closure and container package may be supplied to the packager with the closure so assembled to the package and the lid open. To fill the container with fluid product, a spout 56 of a filling machine is aligned with and may extend into mouth opening 30. Container 22 is thus filled with product 58 through mouth opening 30 and closure base opening 36. After the container has been filled with product and nozzle 56 has been removed, lid 38 is pivoted, for example by means of an automated machine arm 60, from the open position illustrated in FIGS. 1 and 2 to the closed position illustrated in FIG. 3, in which lid 38 is adjacent to closure base 32. In this closed position, bead 54 on fitment 46 is engaged over an external circumferential bead 62 (which may be continuous or segmented) on container finish 28, so that fitment 46 is received and secured by snap fit over the end of the container finish. The package is now ready for shipment. In use by a consumer, lid 38 may be opened and pivoted away from closure base 32, which pulls spud 48 out of fitment 46. Fitment wall 50 thus effectively forms a dispensing opening through which product may dispensed from the package. Fitment 46 remains connected to container finish 28 by means of interlocking snap beads 54, 62. The snap beads hold fitment 46 in sealing engagement with the axial end of the container finish. Fitment 46 preferably is recessed beneath the upper wall of closure base 32, as best seen in FIG. 3, to discourage removal of the fitment from the container finish. With lid 38 closed as illustrated in FIG. 3, spud 48 forms a plug seal within the fitment dispensing opening formed by wall 50.

Figure 4:
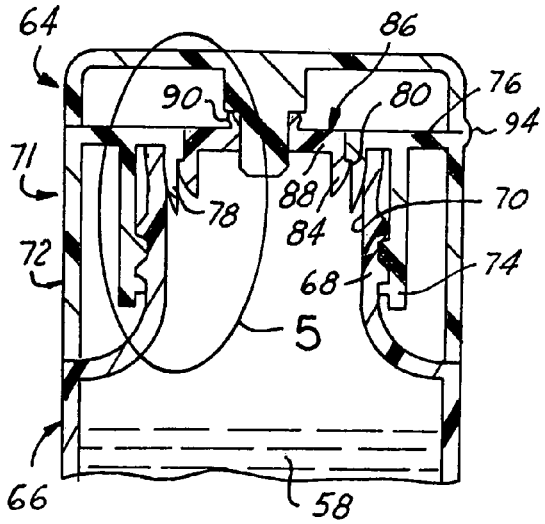
FIG. 4 is a sectional view which is similar to that of FIG. 3 but illustrates a package in accordance with a modified embodiment of the invention.
Figure 5:
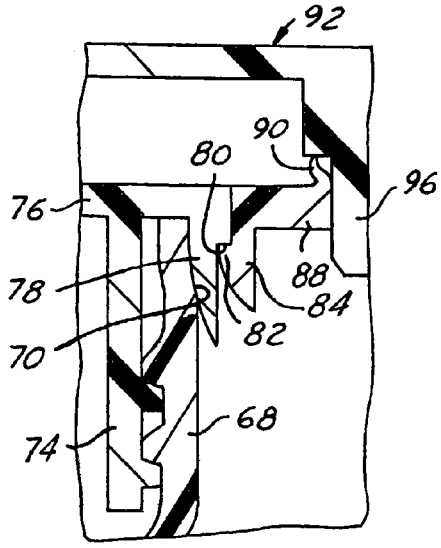
FIG. 5 is a fragmentary sectional view on an enlarged scale of the portion of FIG. 4 within the area 5.

FIGS. 4 and 5 illustrate a closure and container package 64 that is a modification to the package 20 of FIGS. 1–3. A container 66 includes a finish 68 that defines a mouth opening 70. A dispensing closure 71 includes a base 72 with a skirt 74 that is secured to finish 68 by means of one or more engaged beads or threads. The base wall 76 of closure base 72 also has an axially extending annular wall 78 that is received in assembly within finish mouth opening 70 so as to form a plug seal within the finish mouth opening. An annular internal ledge or bead 80 on wall 78 receives an annular external bead 82 on an annular peripheral wall 84 of a fitment 86. As in the embodiment of FIGS. 1–3, fitment 86 also includes an annular base wall 88 and an inner annular wall 90 that forms a dispensing opening. Closure 71 also includes a lid 92 coupled to base 72 by a hinge 94. A spud 96 extends from lid 92 into the dispensing opening of fitment 86 formed by wall 90. As with the embodiment of FIGS. 1–3, fitment 86 is initially assembled to lid 92 with the lid open, and is removably retained in position by friction or other suitable means. The container may be filled with product 58 with closure base 72 mounted on the container finish. Lid 92 is then closed to the position of FIG. 4, at which point bead 82 on fitment 86 is received by snap fit over bead or ledge 80 on closure base 72 to secure the fitment to the closure base. Thereafter, when lid 92 is opened, the fitment forms a dispensing opening, into which spud 96 is received for plug sealing when the lid is closed.

In both embodiments of FIGS. 1–3 and 4–5 (and in the other embodiments to be described), the closure is molded as one unit with the lid connected to the base by the integral hinge. The closure is molded with the lid in the open position, and the fitment is either separately fabricated and assembled to the closure, or is molded onto the closure lid in a secondary molding operation, or is integrally molded on the closure lid using a two-material molding technique. However, it is important that the fitment not be firmly adhered to the lid, so that the fitment will become secured to the container finish or the closure base and release the lid when the lid is thereafter opened. The closure and fitment may be of suitable plastic construction such as polypropylene. The fitment alternatively may be of softer plastic material, such as polyethylene, to enhance sealing engagement between the fitment and the container finish or the closure base, and between the fitment and the lid.

Figure 6:
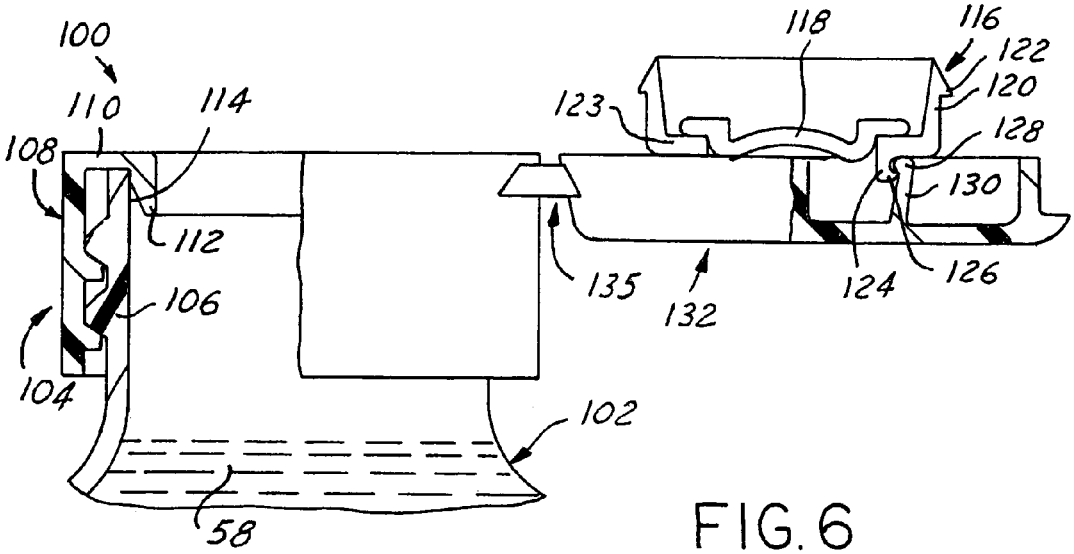
FIG. 6 is a partially sectioned fragmentary elevational view of a package in accordance with a second embodiment of the invention with the closure lid in the initial open position for filling.
Figure 7:
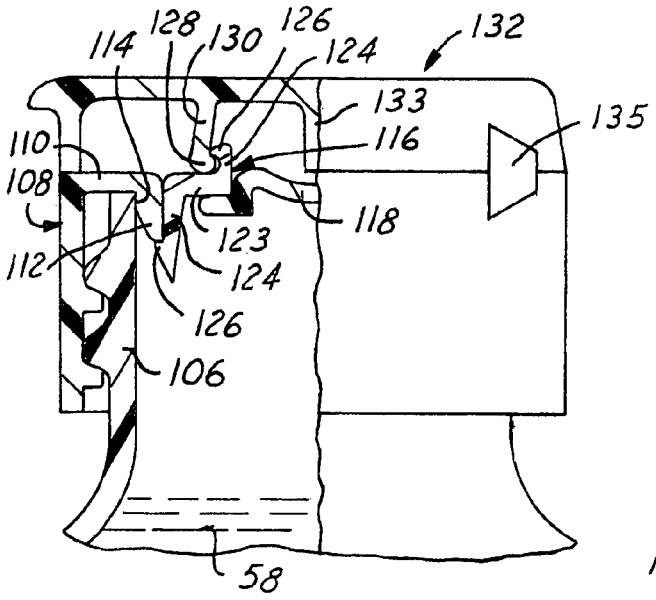
FIG. 7 is a partially sectioned fragmentary elevational view of the package in FIG. 6 with the lid closed after filling.
Figure 8:
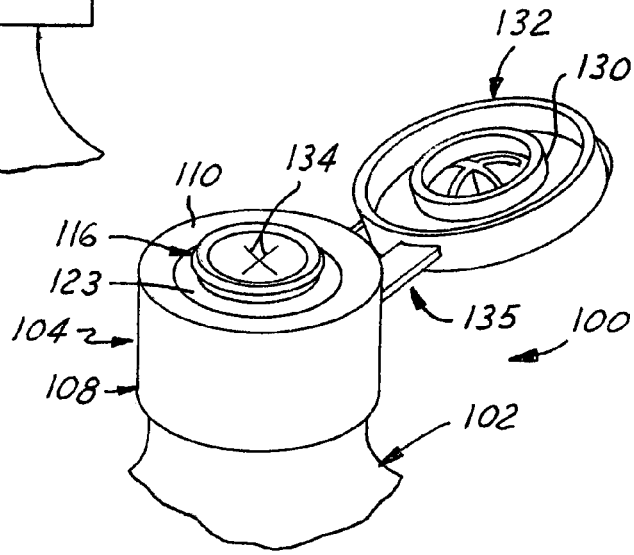
FIG. 8 is a fragmentary perspective view of the package of FIGS. 6–7 with the lid open to dispense product after filling.

FIGS. 6–8 illustrate a closure and container package 100 in accordance with another embodiment of the invention as including a container 102 and a dispensing closure 104. Container 102 has a finish 106, and closure 104 has a base 108 that is secured to finish 106 by suitable threads or beads. Closure base 108 has a base wall 110 from which an annular wall 112 projects for plug sealing engagement within the mouth opening 114 of container finish 106. In this embodiment of the invention, the fitment 116 includes a fitment base to which a dispensing valve 118 is secured. Fitment 116 has an outer peripheral wall 120 having an external snap bead 122, an annular base wall 123, and an inner peripheral wall 124 having an external snap bead 126. Bead 126 is received over an internal bead 128 on an annular wall 130 that extends from the base of the closure lid 132. Valve 118 is of suitable flexible resilient elastomeric material such as liquid silicone rubber, and has a dispensing opening such as the crossed slits 134 illustrated in FIG. 8. Valve 118 may be compression molded in situ on fitment 116, as described for example in U.S. Pat. No. 5,927,567. Valve 118 alternatively may be molded onto fitment 116 in a two-stage molding operation, or may be fabricated separately and secured to fitment 116 by suitable adhesive or other securement elements not illustrated in the drawings. As initially fabricated by the closure manufacturer, lid 132 is open, as illustrated in FIG. 6, and fitment 116 is secured to lid 132 by interlocking beads 126, 128 on annular walls 130, 124. After container 102 has been filled with product 58, lid 132 is pivoted around hinge 135 to the closed position (FIG. 7), at which fitment 116 snaps beneath wall 112 of closure base 108. When lid 132 is thereafter opened by a consumer, for example, beads 126, 128 unsnap and fitment 116 remains secured to closure base 108 as illustrated in FIG. 8. Fluid product may then be dispensed from the package by inverting the package and squeezing the body of the container. Beads 126, 128 provide a mechanism for holding lid 132 closed between uses. A spud 133 on the underside of lid 132 prevents inadvertent opening of valve 118 during shipment and between uses.

Figure 9:
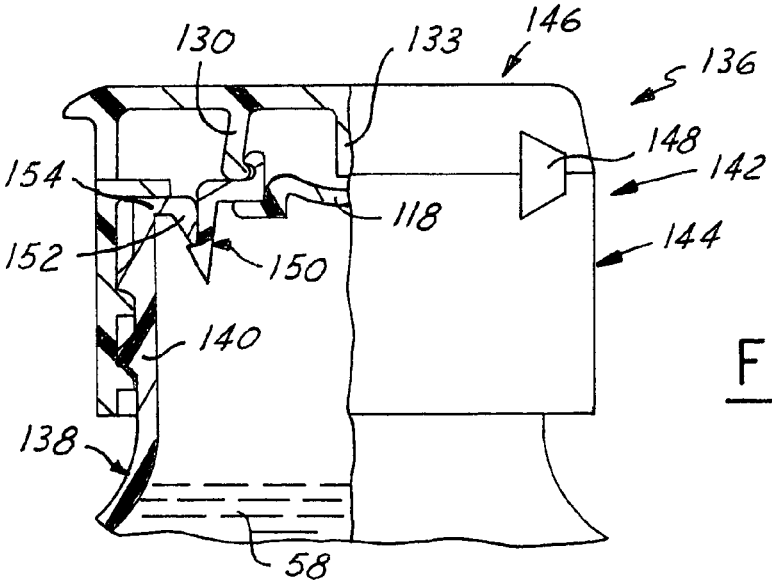
FIG. 9 is a partially sectioned elevation view which is similar to that of FIG. 8 but illustrates a modification to the embodiment of FIGS. 6–8.

FIG. 9 illustrates a package 136 that is a modification to package 100 of FIGS. 6–8. Package 136 includes a container 138 having a finish 140, and a dispensing closure 142 having a base 144 and a lid 146 coupled to base 144 by integral hinge elements 148. Package 136 in FIG. 9 is similar in most respects to package 100 in FIGS. 6–8, except that fitment 150 is snapped beneath a flange 152 that extends axially inwardly from an end wall 154 on container finish 140. That is, whereas fitment 116 snapped beneath a flange 112 on closure base 108 in FIG. 8, fitment 150 snaps beneath a flange 152 on the container finish in FIG. 9. Otherwise, the embodiments of FIGS. 6–8 and 9 are substantially the same.

Figure 10:
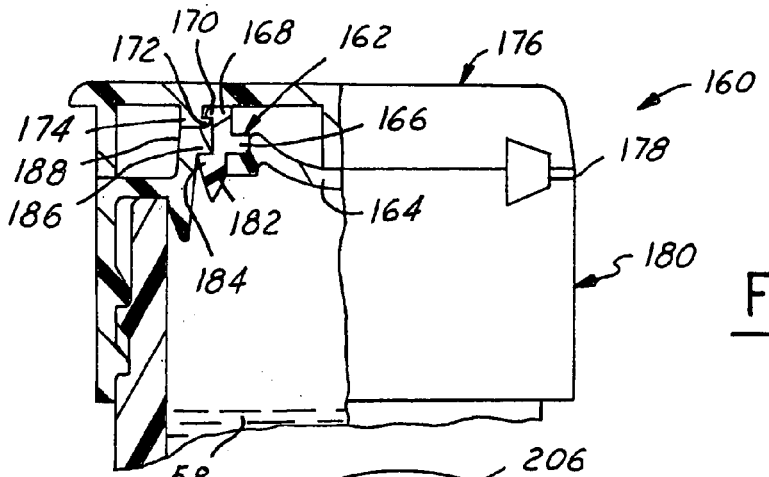
FIG. 10 is a partially sectioned elevational view of another modification to the embodiment of FIGS. 6–8.

FIG. 10 illustrates a package 160 that is another modification to the embodiment of FIGS. 6–8. In the package of FIG. 10, fitment 162 includes an annular base to which an elastomeric dispensing valve 164 is secured. A first annular outer peripheral wall 168 projects from an annular base wall 166, and has an external bead 170 that is received over an internal bead 172 on a wall 174 of closure lid 176. Lid 176 is coupled by hinge 178 to a closure base 180, as in the prior embodiments. A second outer peripheral annular wall 182 extends from fitment base wall 166, and has an external snap bead 184 that is received, in the closed configuration of the closure, beneath a bead 186 on a wall 188 surrounding the opening in closure base 180. The embodiment of FIG. 10 has the advantage that it provides a more axially compact design than the embodiments of FIGS. 6–8 and 9.

Figure 11:
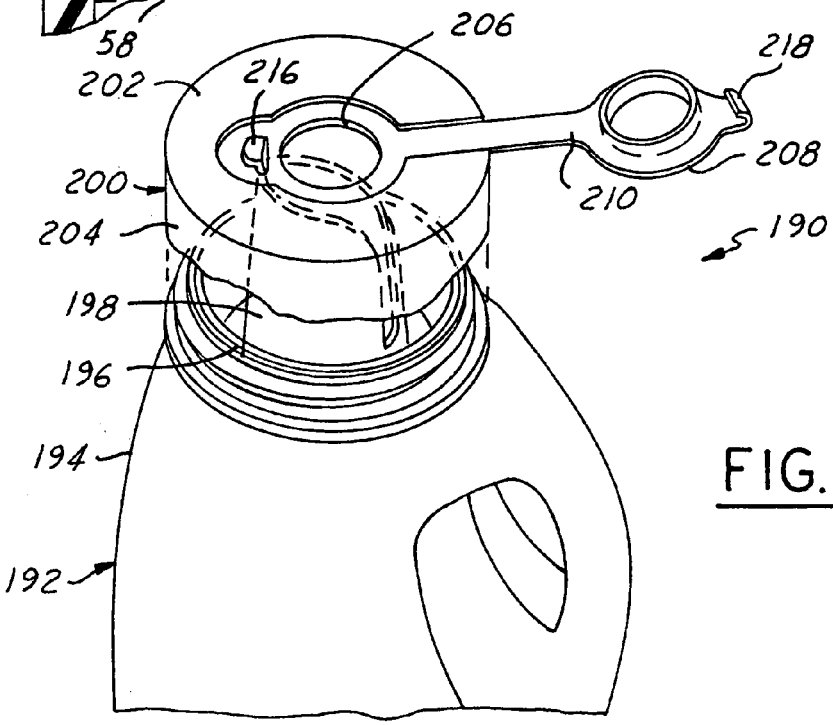
FIG. 11 is a fragmentary perspective view of a closure and container package in accordance with a further embodiment of the invention.
Figure 12:
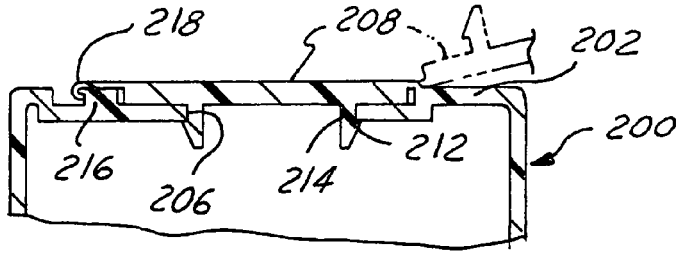
FIG. 12 is a fragmentary sectional view that illustrates the closure in the package of FIG. 11 with the lid closed after filling.

FIGS. 11 and 12 illustrate a closure and container package 190 in accordance with another embodiment of the invention. A container 192 includes a body 194 and a finish 196 with suitable external or internal threads. A spout 198 extends from the container finish for dispensing product from the container. Package 190 includes a closure 200 having a base wall 202 and a peripheral skirt 204 with suitable internal or external threads for mating engagement with the container finish. Packages of this type are conventionally employed for laundry products, and are illustrated for example in U.S. Pat. Nos. 4,917,269, 5,207,356 and 5,941,422. In accordance with the present invention, base wall 202 of closure 200 has a fill opening 206 that aligns in assembly with the dispensing opening of container body 194, finish 196 and spout 198. A lid 208 is connected to closure base wall 202 by a hinge 210 for pivoting between an open position illustrated in FIG. 11 and in phantom in FIG. 12, and a closed position illustrated in solid lines in FIG. 12. In this closed position, an external bead 212 on an annular wall 214 that extends from lid 208 is received by snap fit within the inner periphery of opening 206 in closure base wall 202. A supplemental latch 216 on closure base wall 202, and a latch element 218 on lid 208, optionally may be provided further to hold the lid in the closed position. In this embodiment, the lid is not opened to dispense product, but preferably remains permanently closed after filling. To dispense product, the entire closure is removed from the container finish so that product is dispensed through container spout 198. With lid 208 open as illustrated in FIG. 11 and in phantom in FIG. 12, container 192 may be filled with product through opening 206 in closure base wall 202.

There have thus been disclosed a closure and container package, a dispensing closure, a method of making a dispensing closure, and a method of filling a closure and container package, which fully satisfy all of the objects and aims previously set forth. In particular, in each embodiment, the closure and container may be provided as an assembled unit to the product packager, with a lid on the closure open so that the container may be filled through the base wall of the closure and the dispensing opening of the container. The lid is thereafter closed to form the completed package. The need for stocking and handling separate containers and closures is eliminated. The invention allows containers with non-flat (e.g., round) bottoms (tottles) to be filled in-case. Such containers would otherwise require racks or carriers to hold the containers for individual filling. Such carriers increase the process cost and the process time. The invention has been disclosed in conjunction with several exemplary embodiments, and a number of modifications and variations have been discussed. Other modifications and variations will readily suggest themselves to persons of ordinary skill in the art. The invention is intended to embrace all such modifications and variations as fall within the spirit and broad scope of the appended claims.

What is claimed is:

1. A closure and container package that includes:

a container having a finish with a mouth opening through which product is both filled into and dispensed from said container, and a closure including:

a base mounted on said finish and having an opening aligned with said mouth opening of said container finish, a lid connected to said base by a hinge to pivot between an open position in which said lid is spaced from said opening in said base and a closed position in which said lid is adjacent to said base, said base, said lid and said hinge together being of one-piece integrally molded construction, a fitment removably mounted on said lid and having a dispensing opening, and means on said fitment and on said finish or said closure base for permanently securing said fitment to said finish or said base, first movement of said lid from said open to said closed position, after filling of said container through said mouth and base openings, removing said fitment from mounting on said lid and permanently securing said fitment to said finish or said base such that movement of said lid to said open position after said first movement leaves said fitment secured to said finish or said base and permits dispensing of product from said package through said dispensing opening in said fitment.

2. The package set forth in claim 1 wherein said fitment includes an elastomeric dispensing valve in which said dispensing opening is disposed.

3. The package set forth in claim 1 wherein said fitment has an annular wall with a circumferential bead to engage said mouth opening or said opening in said base to secure said fitment to said finish or said base.

4. The package set forth in claim 3 wherein said finish includes a circumferential bead over which said bead on said fitment wall is received during said first movement of said lid to said closed position.

5. The package set forth in claim 3 wherein said closure base has an annular wall over which said bead on said fitment wall is received during said first movement of said lid to said closed position.

6. The package set forth in claim 5 wherein said annular wall on said closure base is in plug sealing engagement with said mouth opening.

7. The package set forth in claim 1 wherein said fitment has an open dispensing opening, and wherein said lid has a spud on which said dispensing opening on said fitment is removably mounted, said spud being adapted to plug seal said dispensing opening after said first movement of said lid.

8. The package set forth in claim 1 wherein said lid has an annular wall and said fitment has an annular wall initially coupled to said annular wall on said lid, first movement of said lid to said closed position securing said fitment to said closure base or said container finish, subsequent opening of said lid releasing coupling between said lid and said fitment.

9. A closure and container package that includes:

a container having a finish with a mouth opening through which product is both filled into and dispensed from said container, and a closure including:

a base mounted on said finish and having an opening aligned with said mouth opening of said container finish, a lid coupled to said base by a hinge to pivot between an open position in which said lid is spaced from said base and a closed position in which said lid is adjacent to said base, said base, said lid and said hinge together being of one-piece integrally molded construction, and a fitment removably carried by said lid and having a dispensing opening, said fitment including a snap bead for snap-engaging said finish or said closure base to secure said fitment to said one of said finish and said base, such that said package is adapted to be filled with product through said closure base opening and said mouth opening with said lid in said open position and said fitment carried by said lid, and said lid thereafter moved to said closed position to remove said fitment from said lid, secure said bead on said fitment to said container finish or said closure base and position said dispensing opening in alignment with said mouth opening, movement of said lid to said open position thereafter leaving said fitment secured by said bead to said finish or said base and permitting dispensing of product through said dispensing opening of said fitment.

10. The package set forth in claim 9 wherein said dispensing opening on said fitment is open, and wherein said lid includes a spud on which said fitment is initially removably mounted, said spud functioning as a plug seal in said dispensing opening in said closed position of said lid after securement of said fitment to said one of said container finish and said closure base.

11. The package set forth in claim 9 wherein said fitment includes an elastomeric dispensing valve in which said dispensing opening is disposed.

12. The package set forth in claim 9 wherein said fitment has an annular wall on which said snap bead is disposed to engage said one of said finish and said base.

13. The package set forth in claim 12 wherein said finish includes a circumferential bead over which said bead on said fitment wall is received during said first movement of said lid to said closed position.

14. The package set forth in claim 12 wherein said closure base has an annular wall over which said bead on said fitment wall is received during said first movement of said lid to said closed position.

15. The package set forth in claim 14 wherein said annular wall on said closure base is in plug sealing engagement with said mouth opening.

16. A closure and container package that includes:

a container having a finish with a mouth opening through which product is both filled into and dispensed from said container, and a closure including:

a closure base mounted on said finish and having an opening in alignment with said mouth opening of said container finish, a lid coupled to said base by a hinge to pivot between an open position in which said lid is spaced from said base and a closed position in which said lid is adjacent to said base, said lid having an annular wall aligned with said opening on said base wall when said lid is in said closed position, said base, said lid and said hinge together being of one-piece integrally molded construction, and a fitment having an elastomeric dispensing valve, a first annular wall removably mounted to said annular wall on said lid, and a second annular wall including a snap bead for engaging one of said container finish and said closure base to secure said fitment and said dispensing valve to said one of said container finish and said closure base after filling of said container through said opening in said closure base and said mouth opening.

17. The package set forth in claim 16 wherein said finish includes a circumferential bead over which said bead on said fitment wall is adapted to be received.

18. The package set forth in claim 16 wherein said closure base has an annular wall over which said bead on said fitment wall is adapted to be received.

19. The package set forth in claim 18 wherein said annular wall on said closure base is in plug sealing engagement with said mouth opening.

20. A dispensing closure for mounting on a container having a finish with an open mouth, said closure including:

a base for mounting on the container finish and having an opening for alignment with the mouth opening of the container finish, a lid coupled to said base by a hinge to pivot between an open position in which said lid is spaced from said base and a closed position in which said lid is adjacent to said base, said base, said lid and said hinge together being of one-piece integrally molded construction, and a fitment removably by mounted on said lid and having a dispensing opening, said fitment including a snap bead for engaging the container finish or said closure base permanently to secure said fitment to said one of the finish and said base.

21. The closure set forth in claim 20 wherein said dispensing opening on said fitment is open, and wherein said lid includes a spud on which said fitment is initially removably carried, said spud functioning as a plug seal in said dispensing opening in said closed position of said lid after securement of said fitment to the container finish or said closure base.

22. The closure set forth in claim 20 wherein said fitment includes an elastomeric dispensing valve in which said dispensing opening is disposed.

23. The closure set forth in claim 20 wherein said fitment has an annular wall on which said snap bead is disposed to engage the container finish or said closure base.

24. The closure set forth in claim 23 wherein said bead on said fitment wall is adapted to be received over a circumferential bead on the container finish.

25. The package set forth in claim 23 wherein said closure base has an annular wall over which said bead on said fitment wall is adapted to be received.

26. The package set forth in claim 25 wherein said annular wall on said closure base is adapted to be in plug sealing engagement with the mouth opening of the container finish.

27. A closure and container package that includes:

a container having a finish with a mouth opening through which product is both filled into and dispensed from said container, and a closure including:

a base mounted on said finish and having an opening aligned with said mouth opening of said container finish, and a lid connected to said base by a hinge to pivot between an open position in which said lid is spaced from said opening in said base and a closed position in which said lid is adjacent to said base, said base, said lid and said hinge together being of one-piece integrally molded construction, said lid including means for permanent securement to said base permanently closing said opening in said base upon a said first movement to said closed position, said container finish and said closure base including means for removing said closure from said finish to permit dispensing of product through said mouth opening.

* * * * *